United States Patent [19]

Kudo et al.

[11] 4,297,384

[45] Oct. 27, 1981

[54] METHOD OF DEVELOPING ELECTROSTATIC LATENT IMAGE

[75] Inventors: Yoshio Kudo; Masakazu Iwasa; Hisashi Kato, all of Tokyo, Japan

[73] Assignee: Fuji Photo Film Co., Ltd., Minami-ashigara, Japan

[21] Appl. No.: 162,021

[22] Filed: Jun. 23, 1980

Related U.S. Application Data

[63] Continuation of Ser. No. 886,446, Mar. 14, 1978, abandoned.

[30] Foreign Application Priority Data

Mar. 15, 1977 [JP] Japan ..... 52-28363

[51] Int. Cl.[3] ..... G03G 13/08

[52] U.S. Cl. ..... 427/14.1; 118/648; 118/653; 118/661; 430/103; 430/120

[58] Field of Search ..... 427/14.1; 118/653, 657, 118/658, 661, 647, 648; 355/3 DD, 15; 430/103, 120

[56] References Cited

U.S. PATENT DOCUMENTS

| | | | |
|---|---|---|---|
| 3,696,783 | 10/1972 | Fantuzzo | 118/652 |
| 4,089,297 | 5/1978 | Morita et al. | 118/658 |
| 4,091,765 | 5/1978 | Lowthorp et al. | 118/658 |
| 4,119,060 | 10/1978 | Mochizuki et al. | 118/653 |
| 4,121,931 | 10/1978 | Nelson | 118/658 |

FOREIGN PATENT DOCUMENTS

| | | | |
|---|---|---|---|
| 44-2036 | 1/1969 | Japan | 355/15 |

*Primary Examiner*—John H. Newsome

[57] ABSTRACT

In an electrostatic apparatus using a toner layer carried by a developing roller for developing a latent image, a doctor blade applied with a voltage of the same polarity as that of the toner is used for partly scraping the toner layer. The toner scraped off is sucked by a suction means. An additional doctor blade is preferably used together with the main doctor blade to make rough and fine control of the thickness of the toner layer.

3 Claims, 2 Drawing Figures

METHOD OF DEVELOPING ELECTROSTATIC LATENT IMAGE

This is a continuation of application Ser. No. 886,446, filed Mar. 14, 1978 now abandoned.

BACKGROUND OF THE INVENTION

1. Field of the Invention

This invention relates to an apparatus for developing an electrostatic latent image, and more particularly to an apparatus for developing an electrostatic latent image into a toner image in which the thickness of a toner layer used for forming the toner image is controlled by use of a doctor blade to control the density of the toner image.

2. Description of the Prior Art

In a touch down development of a donor development method of electrostatography in which an electrostatic latent image is developed into a toner image by use of a toner carried by a developing roller and the toner image is transferred to a paper or the like or is used as a final image, the image density changes with the thickness of the layer of the toner carried by the developing roller. The thickness of the toner layer is controlled, for instance, by use of a doctor blade projected toward the surface of the developing roller. A part of the toner layer on the developing roller is scraped off by the edge of the doctor blade to obtain the desirable thickness of the toner layer.

The above described apparatus using a doctor blade for controlling the thickness of the toner layer, however, has a defect in that the toner scraped off is liable to stick to the tip of the doctor blade, which results in formation of scratches or lines on the surface of the toner layer and deteriorates the quality of the toner image obtained.

SUMMARY OF THE INVENTION

The primary object of the present invention is to provide a developing apparatus for an electrostatic apparatus provided with a doctor blade for controlling the image density in which the thickness of a toner layer used for forming a toner image is controlled without deteriorating the quality of the toner image.

A specific object of the present invention is to provide a developing apparatus for an electrostatic apparatus provided with a doctor blade for controlling the image density in which a part of the toner layer is scraped off maintaining a smooth surface of the toner layer after scrape.

A more specific object of the present invention is to provide a developing apparatus for an electrostatic apparatus provided with a doctor blade for controlling the image density in which the toner is prevented from sticking to the tip of the doctor blade.

Another object of the present invention is to provide a developing apparatus for an electrostatic apparatus in which the image density is finely controlled by use of two doctor blades.

The above objects of the present invention are accomplished by applying a voltage to the doctor blade used for scraping off a part of the toner layer carried by a developing roller in the same polarity as that of the toner to prevent the toner from sticking to the doctor blade.

Further, said another object of the present invention is accomplished by providing another doctor blade in addition to an ordinary doctor blade so that one of the doctor blades is used as a pre-doctor blade to roughly control the thickness of the toner layer and the other of the doctor blades is used as a main doctor blade to finely control the thickness thereof.

DESCRIPTION OF THE PREFERRED EMBODIMENT

Figure 1:
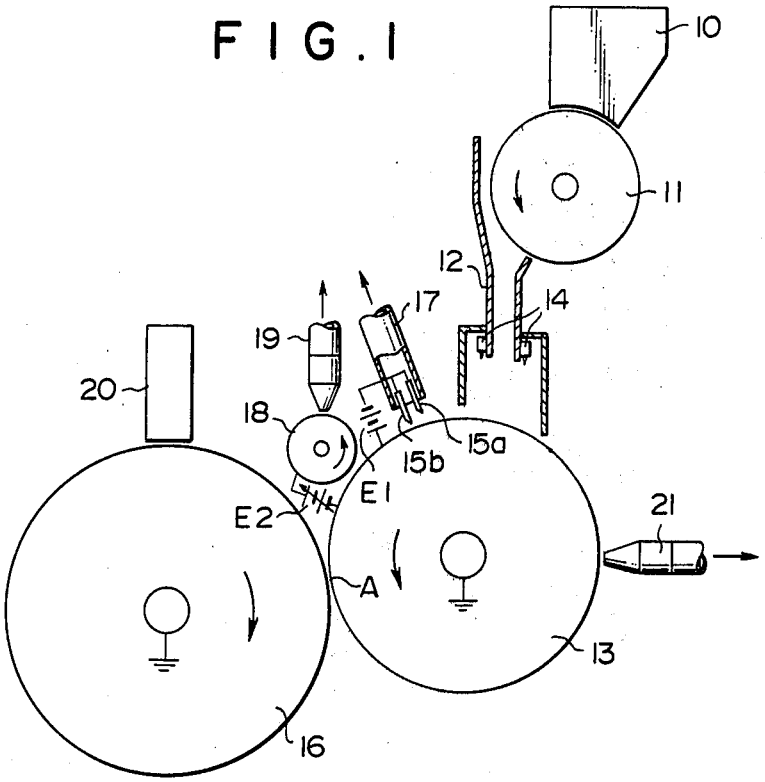
FIG. 1 is a side view partly in section of an embodiment of the developing apparatus in accordance with this invention.

Referring to FIG. 1, a hopper 10 contains therein a developer, i.e. a toner, to be applied on a developing roller 13 by way of a toner feed roller 11 and a guide duct 12. The hopper 10 has an open lower end past which the toner feed roller 11 rotates to take out toner at a predetermined rate. The toner feed roller 11 has on its periphery a number of fine grooves to effectively take out and carry the toner thereon.

The toner taken out of the hopper 10 by the toner feed roller 11 is scattered on a developing roller 13 by way of the guide duct 12. The guide duct 12 is provided with a pair of electrodes 14 for charging the toner passing therethough with negative polarity.

The developing roller 13 shown in FIG. 1 is a metal roller, but a metal belt can also be used. The toner scattered on the developing roller 13 accumulates thereon as a toner layer. The toner layer is first roughly scraped off by a pre-doctor blade **15*a* and is then finely scraped off by a main doctor blade 15*b*. By these two doctor blades 15*a* and 15*b*, the thickness of the toner layer is controlled to obtain a toner image of desirable image density. The thickness of the toner layer is controlled to be equal to the space between the developing roller 13 and an electrostatic latent image carrying drum 16** or to be about 20$\mu$ smaller than the space.

A bias voltage is applied between the developing roller 13 and the doctor blades **15*a* and 15*b* by a bias source E1 so as to prevent the toner from sticking to the tip of the doctor blades 15*a* and 15*b*. The tip of the blades are thus charged to the same polarity as that of the toner to create a repulsive force between the tip of the blades and the toner. Further, in order to discharge the toner scraped off by the doctor blades 15*a* and 15*b*, the doctor blades 15*a* and 15*b* are provided in a suction hood 17**.

Behind, namely downstream of the doctor blades **15*a* and 15*b*, is provided a rotatable squeeze roller 18 made of metal which is applied with a voltage by a power source E2. The squeeze roller 18 is located a proper distance from the surface of the toner layer on the developing roller 13. By the electrostatic force effected by the squeeze roller 18, a part of the toner of the toner layer on the developing roller 13 is attracted to the squeeze roller 18. The strength of the electrostatic force depends upon the level of the voltage applied to the squeeze roller 18 and the space between the squeeze roller 18 and the surface of the toner layer on the developing roller 13. In order to control the strength of the electrostatic force, both the level of the voltage and the space are made controllable. From the practical viewpoint, since it is difficult to control the position of the squeeze roller 18, the electrostatic force is usually controlled mainly by controlling the level of the voltage applied to the squeeze roller 18. Only when the thickness of the toner layer is greatly changed by the doctor blades 15***a* and 15*b*, is the position of the squeeze roller 18 changed to maintain the proper space between the surface of the squeeze roller 18 and the surface of the toner layer on the developing roller 13.

The level of the voltage applied to the squeeze roller 18 is changed according to the speed of rotation of the developing roller 13. Further, the level of applied voltage is desired to be manually controllable in order to allow fine control of the image density. A suction nozzle 19 is provided in the vicinity of the squeeze roller 18 to recover the toner taken up by the squeeze roller 18. The recovered toner is returned to hopper 10 for reuse by the developing apparatus.

The toner layer formed on the developing roller 13 is transferred to the electrostatic latent image carrying drum 16 at the point A in the drawing for developing the latent image into a toner image on the drum 16. The drum 16 is a metal drum or belt carrying thereon an insulating layer. On the insulating layer an electrostatic latent image is formed by use of a number of discharge electrodes 20 in the form of an array of discharge needles. The excessive toner remaining on the developing roller 13 is recovered by a suction nozzle 21 provided in the vicinity of the developing roller 13.

In operation of the above described developing apparatus in accordance with an embodiment of the present invention, the toner in the hopper 10 is taken out at a predetermined rate by the toner feed roller 11 and is scattered on the developing roller 13 by way of the guide duct 12. In the course of the scattering of the toner through the guide duct 12, the toner is charged with negative polarity by the charging electrodes 14.

Figure 2:
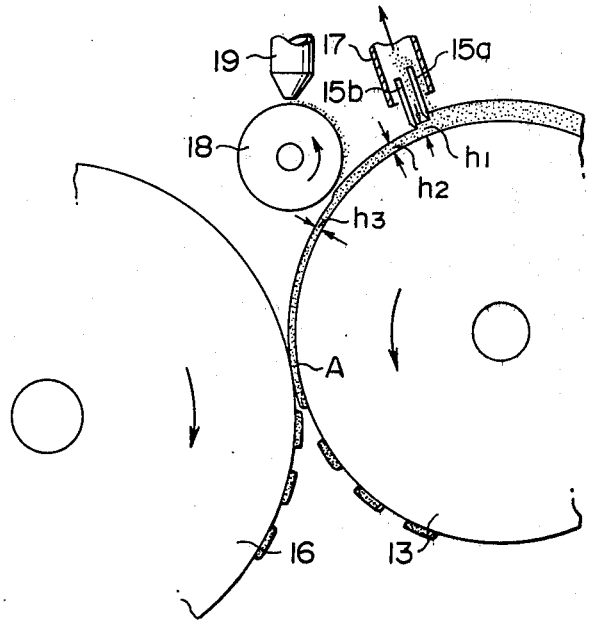
FIG. 2 is a side view partly in section showing the main part of the developing apparatus as shown in FIG. 1 in enlarged scale.

As shown in detail in FIG. 2, the relatively thick toner layer intially applied to the developing roller 13 is partly scraped off by the pre-doctor blade 15*a* to a thickness of h1 and then by the main doctor blade 15*b* to a thickness of h2. The difference between the thicknesses h1 and h2 should preferably be 150μ or less so as to obtain a uniform thickness. The toner scraped off by the doctor blades 15*a* and 15*b* is recovered by the suction hood 17.

The thickness h2 is substantially equal to the space between the surfaces of the electrostatic latent image carrying drum 16 and the developing roller 13. The toner layer having a thickness of h2 then comes to face the squeeze roller 18 and a part of the toner layer is attracted to the squeeze roller 18 by an electrostatic force. The toner attracted to the squeeze roller 18 is recovered by the suction nozzle 19. By the squeeze roller 18, the thickness of the toner layer is reduced to h3. Since the squeeze roller 18 does not touch the surface of the toner layer, the effect thereof is a non-contact scraping effect. Further, excessive toner likely to cause fog is removed by the squeeze roller 18. The level of the voltage applied to the squeeze roller 18 is controlled to become higher with decreasing speed of rotation of the developing roller 13. This is because when the speed of rotation of the developing roller 13 is low, the developing time is long, so that to make the thickness of the toner layer smaller to prevent the image density from becoming too high the level of the voltage applied to the squeeze roller 18 must be made high.

When the developing roller 13 is further rotated and the toner layer is brought to the point A, the toner layer comes to face the electrostatic latent image carried by the drum 16 formed by the discharge electrodes 20 and the toner is attracted by the electrostatic latent image to develop the image into a visible toner image. The toner image is directly or indirectly, by way of a transfer belt of the like, transferred to a recording medium such as a paper or a steel plate. The excessive toner remaining on the developing roller 13 is recovered by the suction nozzle 21.

Now, the present invention will be described in more detail hereinbelow with reference to the results of a test comparing the present invention with prior art. A metal developing roller having a diameter of 300 mm and a length of 350 mm was used. The surface accuracy of the developing roller was 10μ and the surface accuracy of the edge of the main doctor blade used together therewith was 20μ. The space between the edge of the main doctor blade and the surface of the developing roller was 400μ. The developing roller was rotated at a peripheral speed of 50 m/min. Thus, a toner layer of a toner having a mean grain size of 30μ applied on the developing roller to a thickness of 1.5 mm was partly scraped off. The toner was an epoxy resin type toner. Consequently, scratches were observed on the surface of the toner layer, and the surface of the toner layer had a roughness of 250μ. The suction rate of the suction hood was 4.0 m/sec.

Then, a bias voltage was applied to the doctor blade to apply a negative voltage of −300 V to the doctor blade. The toner was charged with negative polarity in advance. Consequently, the surface roughness was reduced to 130μ.

Further, an additional pre-doctor blade having the same structure as that of the main doctor blade was used. The pre-doctor blade was located 1 cm apart from the main doctor blade and 150μ higher than the main doctor blade. As a result, the surface roughness was further reduced to 80μ. Then, the level of the pre-doctor blade was changed from 150μ to 100μ higher than the main doctor blade. Consequently, the surface roughness was further reduced to 50μ.

Then, the suction hood was removed to stop the recovery of the toner. As a result, the surface roughness was increased to 400μ and there appeared several areas where no toner was applied on the surface of the developing roller. Then, the suction hood was attached, but the doctor blades were applied with a voltage of the opposite polarity to that of the toner. Consequently, the surface roughness was 250μ and scratches were observed on the surface of the toner layer.

We claim:

1. A method of developing an electrostatic latent image by use of an apparatus comprising an electrostatic latent image carrying member, a developing roller member for applying a toner layer on the electrostatic latent image carrying member, and a doctor blade associated with the developing roller member for scraping off a part of the toner layer for controlling the thickness of the toner layer wherein said doctor blade is applied with a voltage in the same polarity as that in which the toner is charged, said doctor blade having an edge located close to the surface of the developing member to scrape off a part of the toner layer on the developing member to obtain a predetermined thickness of the toner layer, and the toner scraped off by said doctor blade is sucked and exhausted by a suction means connected with said doctor blade, whereby the toner is prevented from sticking to the doctor blade.

2. A method of developing an electrostatic latent image as claimed in claim 1 wherein said suction means is a suction hood, and said doctor blade is located in said suction hood.

3. A method of developing an electrostatic latent image as claimed in claim 1 wherein a predoctor blade is located upstream of said doctor blade, said predoctor blade being applied with a voltage of the same polarity as that in which the toner is charged.

* * * * *